US005517774A

United States Patent [19]

Rogers

[11] Patent Number: 5,517,774

[45] Date of Patent: May 21, 1996

[54] EARTH BORING ROTARY TOOL WITH AXIAL FEED

[76] Inventor: J. Frank Rogers, 623 Green Meadow La., Midlothian, Tex. 76065

[21] Appl. No.: 293,307

[22] Filed: Aug. 22, 1994

[51] Int. Cl.[6] ..... E21B 7/00

[52] U.S. Cl. ..... 37/189; 173/150; 175/57

[58] Field of Search ..... 37/188, 189, 190, 37/304; 173/145, 148, 150, 28; 175/122, 135, 162, 195, 203, 57

[56] References Cited

U.S. PATENT DOCUMENTS

| | | | |
|---|---|---|---|
| 2,598,203 | 5/1952 | Acker, Jr. | 173/150 |
| 2,856,155 | 10/1958 | Putt | 173/150 X |
| 3,519,088 | 7/1970 | Bayless | 173/150 X |
| 3,768,578 | 10/1973 | Russell, Jr. | 173/150 |

*Primary Examiner*—Terry Lee Melius
*Assistant Examiner*—Robert Pezzuto
*Attorney, Agent, or Firm*—Timmons & Kelly; H. Dennis Kelly

[57] ABSTRACT

A hydraulic motor is mounted on top of a hydraulic cylinder barrel. The barrel houses a drive shaft that is rotated by the motor. A male hex drive shaft, attached to the drive shaft, extends downward through the barrel. A piston is mounted within the barrel and moves linearly along the male hex drive shaft. Attached to the piston is a piston rod having an upper portion, a center portion, and a lower portion. The center portion defines a rod chamber for accommodating the male hex drive shaft as the piston and the piston rod move upward. The upper portion has a hexagonal inner surface for rotation and sliding movement along the male hex drive shaft. A passage through the center portion allows fluid to flow between the rod chamber and the upper chamber of the cylinder barrel.

15 Claims, 4 Drawing Sheets

EARTH BORING ROTARY TOOL WITH AXIAL FEED

BACKGROUND OF THE INVENTION

1. Field of the Invention

This invention relates in general to machinery for boring holes in the earth. In particular, the invention relates to a earth boring tool for attachment to a prime mover such as a backhoe.

2. Description of Related Art

Earth boring rotary tools have been in use for many years. However, there still remains room for improvement. Many tools are too large or too complicated to be easily attached to a prime mover, such as a backhoe. Also, many tools have the thrust offset from the center of rotation, which causes cocking.

Some prior art tools have had a three part piston rod, with a center portion defining a rod chamber for accommodating a drive shaft as the piston moves upward. Problems arose when the rod chamber decreased in volume, thus greatly increasing the pressure in the rod chamber. These highly increased pressures have caused hydraulic leaks and, in some cases, catastrophic failures.

A need existed for an earth boring rotary tool having some apparatus for relieving the fluid pressure in the rod chamber. Also, the tool needed to have the thrust concentric with the center of rotation to prevent cocking. In addition, the tool needed to be easily adaptable to various uses.

SUMMARY OF THE INVENTION

The general object of the invention is to provide a versatile, durable tool for boring holes in the earth. In general, this object is accomplished by an earth boring rotary tool having a hydraulic motor mounted on top of a hydraulic cylinder barrel. The hydraulic barrel houses a drive shaft that is rotated by the motor. A male hex drive shaft is attached to the drive shaft, and extends downward through the barrel. A piston, mounted within the barrel, allows the piston rod to rotate with and moves linearly along the male hex drive shaft.

Attached to the piston is a piston rod having an upper portion, a center portion, and a lower portion. The center portion defines a chamber for accommodating the male hex drive shaft as the piston and the piston rod move upward. The upper portion has a hexagonal inner surface for rotation and sliding movement along the male hex drive shaft. A passage through the upper portion allows fluid to flow between the rod chamber and the upper chamber of the cylinder barrel.

The above, as well as additional objects, features, and advantages of the invention will become apparent in the following detailed description.

DESCRIPTION OF THE PREFERRED EMBODIMENT

Figure 1:
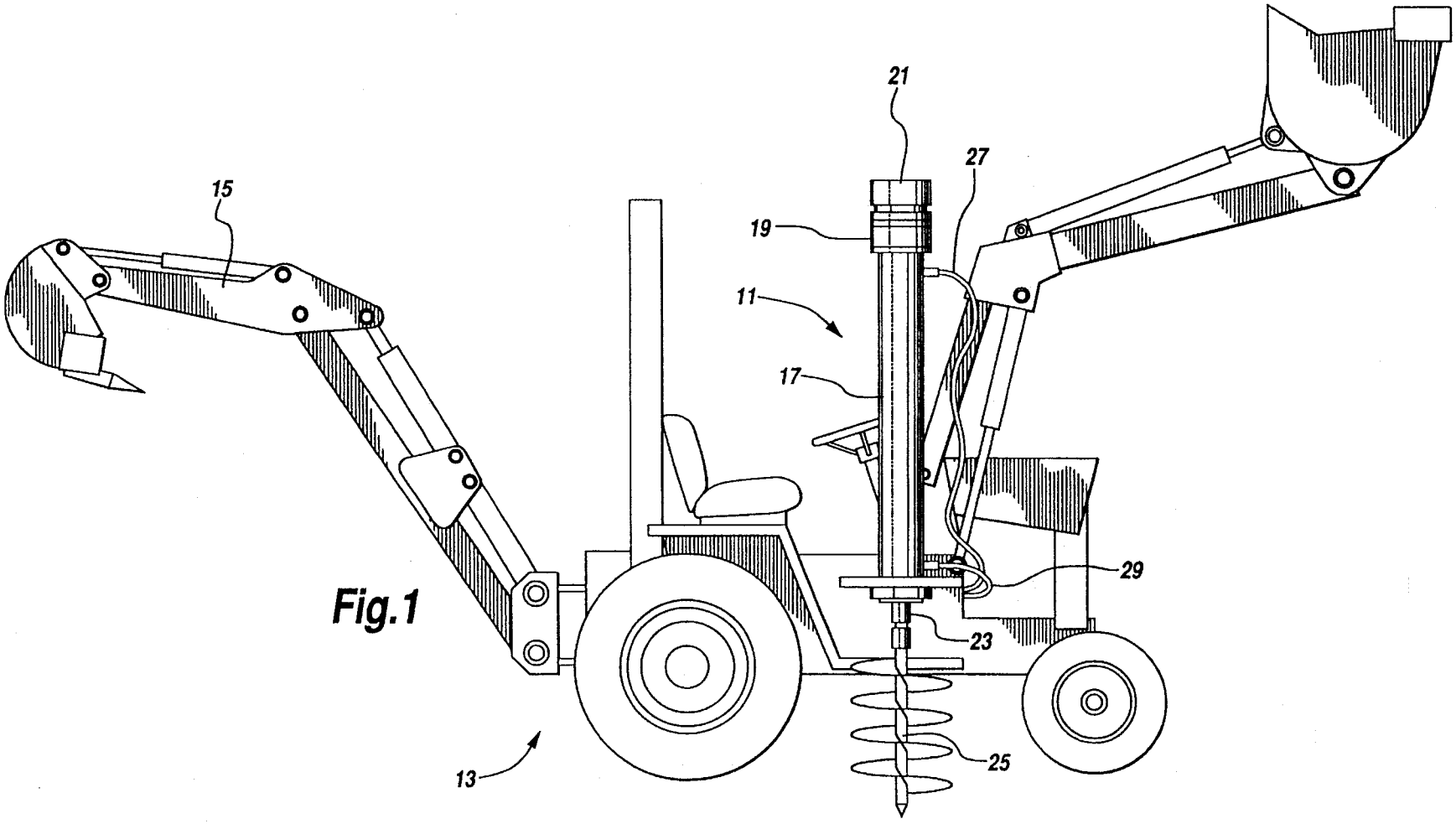
FIG. 1 is a side elevation of a backhoe with an earth boring rotary tool installed according to the invention.

FIG. 1 illustrates the preferred embodiment of the earth boring tool 11 of the invention, mounted on the side of a backhoe 13. The tool 11 could also be mounted on the rear extension 15 of the backhoe 13. If mounted on the rear extension 15, the tool 11 can be pivoted to an angle other than vertical, in order to drill at a non-vertical angle.

As seen in FIG. 1, the rotary tool 11 of the invention has a cylindrical cylinder barrel 17. An upper body 19 is mounted on top of the cylinder barrel 17, and a hydraulic motor 21 is mounted on top of the upper body 19.

A piston rod assembly 23 extends downward from the bottom of the cylinder barrel 17. An auger bit 25 is attached to the lower end of the piston rod assembly 23.

Hydraulic power is supplied from the backhoe 13 to the tool 11 through a pair of hydraulic lines 27 and 29. Hydraulic power from the backhoe 13 also powers the hydraulic motor 21.

Figure 2:
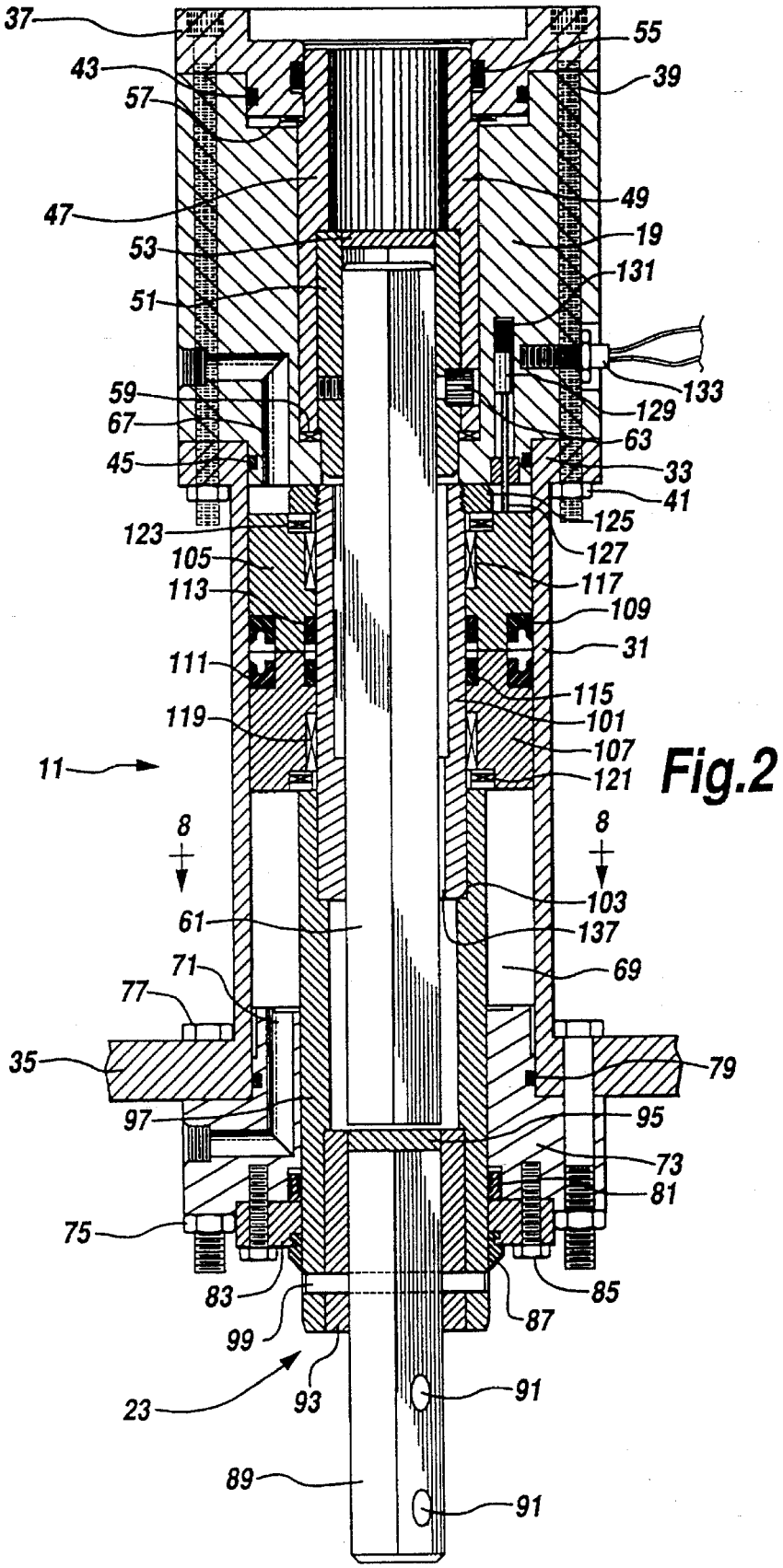
FIG. 2 is a cross sectional side view of the earth boring rotary tool, with the auger drive rod in the upper position.
Figure 3:
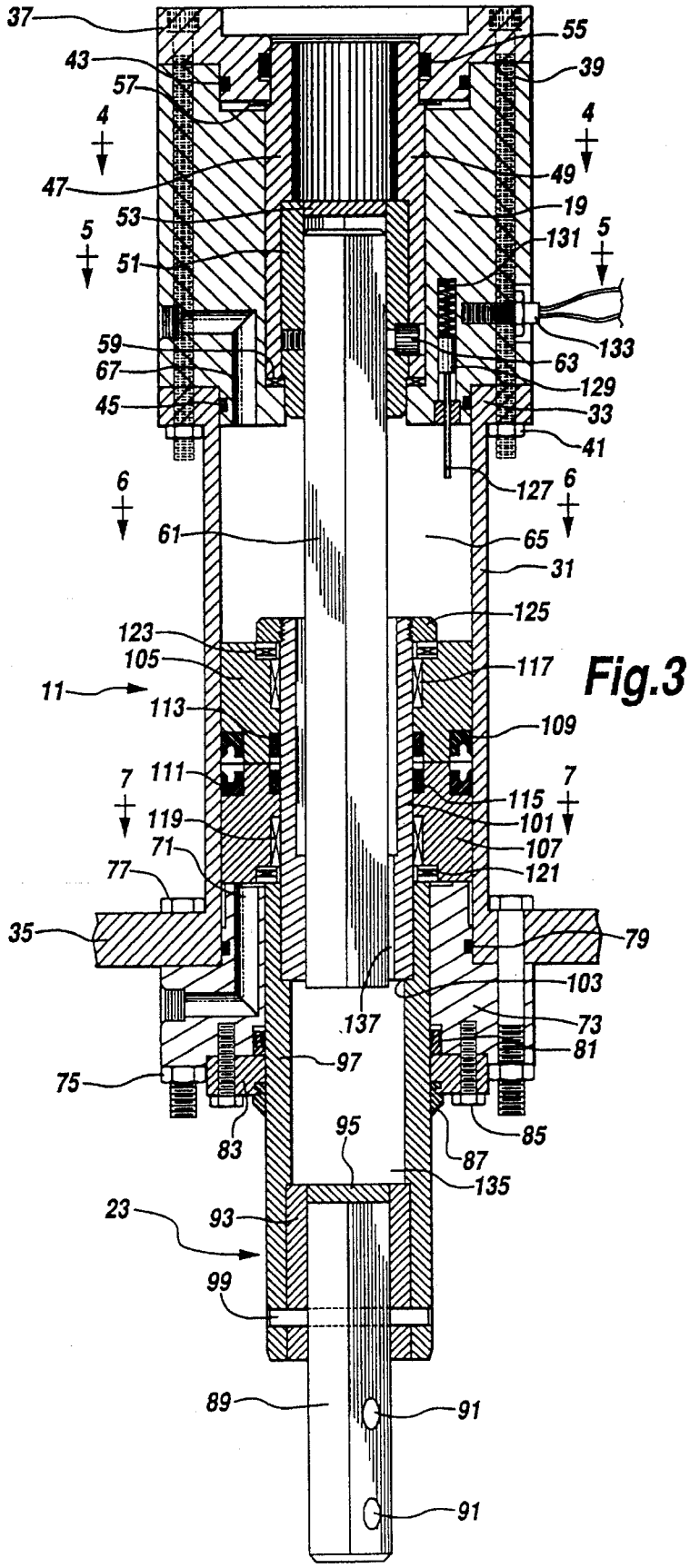
FIG. 3 is a cross sectional side view of the earth boring rotary tool, with the auger drive rod in the lower position.
Figure 4:
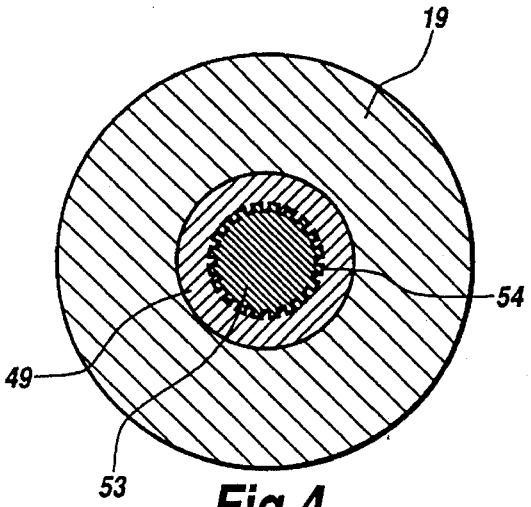
FIG. 4 is a cross sectional view of the earth boring rotary tool, as seen along lines 4—4 in FIG. 3.

FIGS. 2 and 3 illustrate the tool 11 in greater detail. The figures have been truncated for simplicity. FIG. 2 shows the piston rod assembly 23 in an upper position, and FIG. 3 shows the piston rod assembly 23 in a lower position.

The cylinder barrel 17 of the tool 11 has a central cylindrical portion 31, with an upper flange 33 and a lower flange 35. The upper body 19 is attached to the upper flange 33, and a motor adapter 37 is attached to the upper body 19. Several thru bolts 39 extend through the motor adapter 37, the upper body 19, and the upper flange 33, to connect the elements together. A nut 41 on the lower end of each thru bolt 39 secures the elements together. An upper O-ring 43 seals between the motor adapter 35 and the upper body 19, and a lower O-ring 45 seals between the upper body 19 and the upper flange 33.

A drive shaft 47 is mounted within the upper body 19. The drive shaft 47 consists of three parts: a female splined end 49, a female hex end 51, and a male hex plug 53.

The splined end 49 of the drive shaft 47 meshes with the hydraulic motor 21 (shown in FIG. 1) so that the motor 21 can rotate the drive shaft 47 within the non-rotating upper body 19. The splined end 49 can be machined to accept motors of various sizes, or can be machined to accept straight keyed shaft motors of various sizes.

A shaft seal 55 seals between the splined end 49 and the motor adapter 37. An upper needle thrust bearing 57 and two thrust washers are located between the motor adapter 37 and a shoulder on the splined end 49. Similarly, a lower needle thrust bearing 59 and two thrust washers are located between the splined end 49 and a shoulder on the upper body 19.

Figure 5:
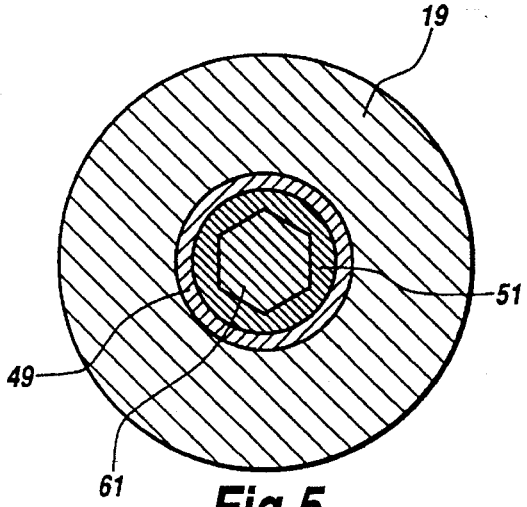
FIG. 5 is a cross sectional view of the earth boring rotary tool, as seen along lines 5—5 in FIG. 3.

A male hex drive shaft 61 fits within the female hex end 51, as shown in FIGS. 2, 3, and 5, and extends downward through the cylinder barrel 17. The male hex drive shaft 61 is connected to the drive shaft 47 with an allen head cap screw 63. Therefore, the male hex drive shaft 61 rotates with the drive shaft 47, as the hydraulic motor 21 rotates the drive shaft 47.

Figure 6:
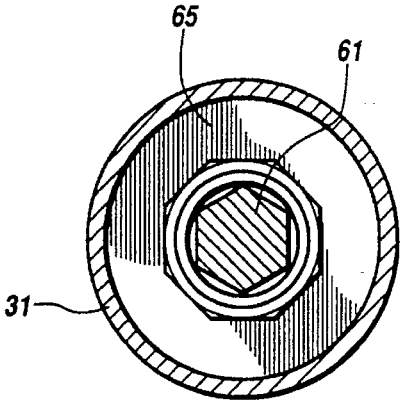
FIG. 6 is a cross sectional view of the earth boring rotary tool, as seen along lines 6—6 in FIG. 3.
Figure 7:
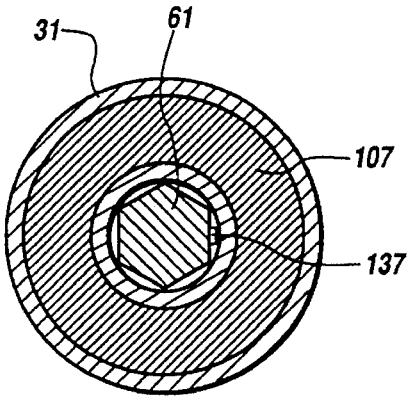
FIG. 7 is a cross sectional view of the earth boring rotary tool, as seen along lines 7—7 in FIG. 3.

The annular area between the cylindrical portion of the cylinder barrel 31 and the male hex drive shaft 61 forms an upper chamber 65, as shown in FIGS. 3 and 6. Hydraulic pressure is applied to, or relieved from, the upper chamber 65 through an upper hydraulic port 67 in the upper body 19. Hydraulic pressure is provided to the upper hydraulic port 67 through the upper hydraulic line 27, shown in FIG. 1.

Figure 8:
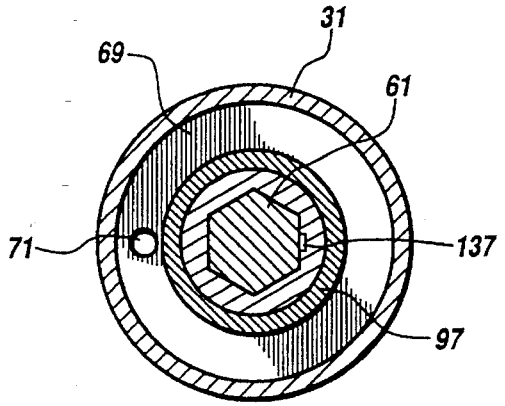
FIG. 8 is a cross sectional view of the earth boring rotary tool, as seen along lines 8—8 in FIG. 2.

Another annular area within the cylindrical portion of the cylinder barrel 31 forms a lower chamber 69, as shown in FIGS. 2 and 8. Hydraulic pressure is applied to, or relieved from, the lower chamber 69 through a lower hydraulic port 71. Hydraulic pressure is provided to the lower hydraulic port 71 through the lower hydraulic line 29, shown in FIG. 1.

The lower hydraulic port 71 passes through a rod end bell 73 attached to the lower flange 35 of the barrel cylinder 17. The rod end bell 73 is connected to the lower flange 35 with several nuts 75 and bolts 77. An O-ring 79 seals between the rod end bell 73 and the lower flange 35.

A shaft seal 81 is located within an annular seal groove in the rod end bell 73. The shaft seal 81 is held in place by a shaft seal retainer 83, which is connected to the rod end bell 73 by several cap screws 85. The shaft seal retainer 83 also holds a rod wiper 87.

The auger bit 25, shown in FIG. 1, is attached to the bottom of a piston rod assembly 23. The details of the piston rod assembly 23 are shown in FIGS. 2 and 3. FIG. 2 shows the piston rod assembly 23 in the upper position, and FIG. 3 shows the piston rod assembly 23 in the lower position.

The lower end of the piston rod assembly 23 is a hexagonal drive rod 89. The drive rod 89 has one or two holes 91 for attachment of the auger bit 25.

The upper end of the drive rod 89 is secured within a female hex auger drive adapter 93. The upper end of the female hex auger drive 93 is covered by a male hex plug 95. The entire female hex auger drive 93 is surrounded by the lower end of a hollow cylindrical portion of the piston rod 97. The hex auger drive rod 89 and the female hex auger drive adapter 93 are secured in the lower end of the center portion of the piston rod 97 by an auger drive rod retainer 99.

An upper portion 101 of the piston rod is inserted into the upper end of the center portion 97 of the piston rod. The upper portion 101 has a cylindrical outer surface, and the lower end of the upper portion 101 bears on an annular shoulder 103 on the center portion 97. The upper end of the upper portion 101 has a circular inner surface, and the lower end of the upper portion 101 has a hexagonal inner surface that slides along the length of the male hex drive shaft 61.

A piston, consisting of an upper half 105 and a lower half 107, is mounted around the upper portion 101 of the piston rod. A pair of piston seals 109 and 111 seal between the piston halves 105 and 107 and the inner surface of the cylindrical portion 31 of the cylinder barrel 17. A pair of shaft seals 113 and 115 seal between the piston halves 105 and 107 and the upper portion 101 of the piston rod.

A pair of radial needle bearings 117 and 119 are mounted between the piston halves 105 and 107 and the upper portion 101 of the piston rod. A pair of needle thrust bearings 121 and 123 (with two thrust washers each) are located on each end of the piston halves 105 and 107. The lower needle thrust bearing 121 is located between the lower half 107 of the piston and the upper end of the center portion 97 of the piston rod.

The upper needle thrust bearing 123 is located on top of the upper half 105 of the piston. A bearing retainer nut 125 is threaded onto the top of the upper portion 101 of the piston rod to secure the upper and lower needle thrust bearing 121 and 123 and the two halves 105 and 107 of the piston to the upper end of the center portion 97 of the piston rod.

The piston and the piston rod move between an upper position, shown in FIG. 2, and a lower position, shown in FIG. 3. When in the upper position, the upper half 105 of the piston pushes upwards on a proximity switch actuator 127. In turn, the proximity switch actuator 127 pushes upward on a permanent magnet 129.

A nonmagnetic coil spring 131 biases the permanent magnet 129 and the proximity switch actuator 127 in the downward position, shown in FIG. 3, when the piston is in the lower position. When the piston is in the upper position, shown in FIG. 2, the proximity switch actuator 127 and the permanent magnet 131 are pushed to the upper position. A proximity switch 133 senses the proximity of the permanent magnet 131, and indicates that the piston and piston rod are in the upper position. A signal is sent to allow the backhoe 13 to be driven. When the piston rod is not in the upper position, the proximity switch 133 senses the absence of the permanent magnet 131 and a signal is sent to disable the backhoe 13. Therefore, the backhoe 13 cannot be driven while the auger bit 25 is still in the ground.

The center portion 97 of the piston rod is hollow, and encloses a rod chamber 135. The volume of the rod chamber 135 changes as the piston moves up and down. As the piston moves upward, the volume of the rod chamber 135 decreases. As the volume decreases, pressure in the rod chamber 135 will build to unacceptable levels, unless the pressure is relieved.

In order to relieve the pressure in the rod chamber 135, a passage 137 is provided through the upper portion 101 of the piston rod. In the preferred embodiment, the passage 137 is a keyway cut into one of the six faces of the hexagonal inner surface of the upper portion 101 of the piston rod.

One possible alternative would be a hole drilled longitudinally through the male hex drive 61. A relief hole would be drilled radially from one face to intersect with the drilled hole. Another alternative would be to machine the male hex drive 61 to provide a keyway or a passage between the rod chamber 135 and the upper chamber 65. Another method would be to mill or grind off one corner of the male hex drive shaft 61.

In operation, the rotary tool 11 of the invention can be mounted on the side or on the rear of a standard backhoe 13. The hydraulic motor 21 rotates the drive shaft 47 to rotate the male hex drive shaft 61. The male hex drive shaft 61 rotates the upper portion 101 and the center portion 97 of the piston rod. The center portion 97 of the piston rod then rotates the drive rod adapter 93, which in turn drives the drive rod 89 on which the auger bit 25 is mounted.

As the auger bit 25 is being rotated, hydraulic pressure is applied through the upper hydraulic port 67 to the top of the piston 105. The pressure forces the piston 105 and the piston rod downward to drill the hole.

After the hole has been drilled, hydraulic pressure is applied through the lower hydraulic port 71 to the bottom of the piston 107. The hydraulic pressure pushes the piston 107 and the piston rod upward.

The earth boring rotary tool of the invention has several advantages over the prior art. The tool allows fluid to escape from the rod chamber 135 as the drive rod 89 is raised, thus preventing catastrophic failure. Also, the tool is very versatile, since the stroke can be made any length, limited only by the length of honed tubing available. The tool can be used on a variety of prime movers, including most construction vehicles. Since the thrust is concentric with the rotation, the tool will not cock, and can be used to bore into hard rock. The tool is safer than the prior art tools, partly because of the proximity switch, which disables the prime mover if the piston rod assembly 23 is not in the raised position.

The invention has been described in only one embodiment. It should be apparent to those skilled in the art that the invention is not so limited, but is susceptible to various changes and modifications without departing from the spirit of the invention.

I claim:

1. An earth boring rotary tool, comprising:

a cylinder barrel;

a motor mounted on the barrel;

a drive shaft extending downward through the barrel for rotation by the motor, wherein the drive shaft is linearly stationary relative to the barrel;

a piston mounted within the barrel for linear movement along the length of the drive shaft between an upper position and a lower position and dividing the cylinder barrel into an upper chamber and a lower chamber;

a piston rod, connected to the piston for linear movement with the piston, connected to the drive shaft for rotational movement with the drive shaft, and defining a rod chamber for accommodating the drive shaft as the piston and the piston rod move upward;

a passageway defined between the rod chamber and the upper chamber to allow fluid to flow from the rod chamber to the upper chamber as the piston and the piston rod move upward and the rod chamber becomes smaller;

a drive rod attached to the piston rod for rotation with the piston rod; and an auger bit attached to the drive rod for rotation with the drive rod.

2. An earth boring rotary tool, as recited in claim 1, wherein the piston rod has an upper end which passes through the piston, and the passageway passes through the upper end of the piston.

3. An earth boring rotary tool, as recited in claim 2, wherein the passageway is a keyway on an interior surface of the upper portion of the piston rod.

4. An earth boring rotary tool, as recited in claim 3, wherein the interior surface of the upper portion of the piston rod is hexagonal, and the keyway is a rectangular groove cut into one planar surface of the hexagonal internal surface of the upper portion of the piston rod.

5. An earth boring rotary tool, as recited in claim 1, further comprising a proximity switch for preventing movement of a prime mover to which the rotary tool is attached when the piston is not in the upper position.

6. An earth boring rotary tool, comprising:

a cylinder barrel;

a motor mounted on the barrel;

a drive shaft extending downward through the barrel for rotation by the motor, wherein the drive shaft is linearly stationary relative to the barrel;

a piston mounted within the barrel for linear movement along the length of the drive shaft between an upper position and a lower position and dividing the cylinder barrel into an upper chamber and a lower chamber;

a piston rod, connected to the piston for linear movement with the piston, connected to the drive shaft for rotational movement with the drive shaft, and defining a rod chamber for accommodating the drive shaft as the piston and the piston rod move upward;

venting means for allowing fluid to flow from the rod chamber to the upper chamber as the piston and the piston rod move upward and the rod chamber becomes smaller;

a drive rod attached to the piston rod for rotation with the piston rod; and an auger bit attached to the drive rod for rotation with the drive rod.

7. An earth boring rotary tool, as recited in claim 6, wherein the venting means includes a passageway.

8. An earth boring rotary tool, as recited in claim 7, wherein the piston rod has an upper end which passes through the piston, and the passageway passes through the upper end of the piston.

9. An earth boring rotary tool, as recited in claim 7, wherein the passageway is a keyway on an interior surface of the upper portion of the piston rod.

10. An earth boring rotary tool, as recited in claim 9, wherein the interior surface of the upper portion of the piston rod is hexagonal, and the keyway is a rectangular groove cut into one planar surface of the hexagonal internal surface of the upper portion of the piston rod.

11. An earth boring rotary tool, as recited in claim 6, further comprising a proximity switch for preventing movement of a prime mover to which the rotary tool is attached when the piston is not in the upper position.

12. An earth boring rotary tool, comprising:

a prime mover;

a hydraulic cylinder barrel having an upper chamber;

a hydraulic motor mounted on top of the barrel;

a drive shaft mounted within the barrel for rotation by the hydraulic motor;

a male hex drive shaft attached to the drive shaft and extending downward through the barrel;

a piston mounted within the barrel for linear movement along the length of the barrel between an upper position and a lower position;

a lower portion of a piston rod, extending downward out of the barrel for holding an auger bit;

a center portion of a piston rod, connected to the lower portion, and defining a rod chamber for accommodating the male hex drive as the piston moves upward; and an upper portion of a piston rod, connected to the lower portion of the piston rod, mounted to the piston for linear movement with the piston, and having a hexagonal inner surface for rotation and sliding movement along the length of the male hex drive, wherein the upper portion has a passage to allow fluid to flow between the rod chamber and the upper chamber of the cylinder barrel.

13. An earth boring rotary tool, as recited in claim 12, wherein the passage is a keyway on the internal surface of the upper portion of the piston rod.

14. An earth boring rotary tool, as recited in claim 13, wherein the keyway is a rectangular groove cut into one planar surface of the hexagonal internal surface of the upper portion of the piston rod.

15. An earth boring rotary tool, as recited in claim 12, further comprising a proximity switch for preventing movement of the prime mover when the piston is not in the upper position.

* * * * *